US007244039B1

(12) United States Patent
Emmons et al.

(10) Patent No.: US 7,244,039 B1
(45) Date of Patent: Jul. 17, 2007

(54) LIGHTING SYSTEM

(76) Inventors: Todd O. Emmons, 820 Georgia Ave., Palm Harbor, FL (US) 34683; Teresa C. Emmons, 820 Georgia Ave., Palm Harbor, FL (US) 34683

( * ) Notice: Subject to any disclaimer, the term of this patent is extended or adjusted under 35 U.S.C. 154(b) by 0 days.

(21) Appl. No.: 11/438,860

(22) Filed: May 23, 2006

(51) Int. Cl.
*F21W 131/107* (2006.01)

(52) U.S. Cl. ..... 362/145; 362/648; 362/152; 362/249; 362/225

(58) Field of Classification Search ..... 362/648, 362/145, 151, 152, 249, 252, 253, 225, 219; 242/390, 390.2, 564
See application file for complete search history.

(56) References Cited

U.S. PATENT DOCUMENTS 6,364,508 B1 * 4/2002 Moreland ..... 362/249
6,585,394 B2 * 7/2003 Diaco ..... 362/249
6,652,121 B1 * 11/2003 Kneeshaw ..... 362/249
6,846,092 B2 * 1/2005 Taylor et al. ..... 362/249

* cited by examiner

*Primary Examiner*—Laura Tso
(74) *Attorney, Agent, or Firm*—Edward P. Dutkiewicz

(57) ABSTRACT

A track assembly is adapted to be coupled beneath eaves of a building. The track assembly has forward and return. A slot is provided in the lower surface of the forward track. Spaced balls are provided in each track. A primary cord is in a continuous loop extending through the forward and return tracks. A plurality of secondary members is adapted to depend from the primary cord through the slot to beneath the track assembly. A spool is provided in proximity to the track assembly and primary cord. A motor rotates the spool and moves the primary cord in a first direction to position the secondary members in the forward track in an operative orientation and in a secondary direction to position the secondary members in an inoperative orientation.

8 Claims, 6 Drawing Sheets

FIG 1
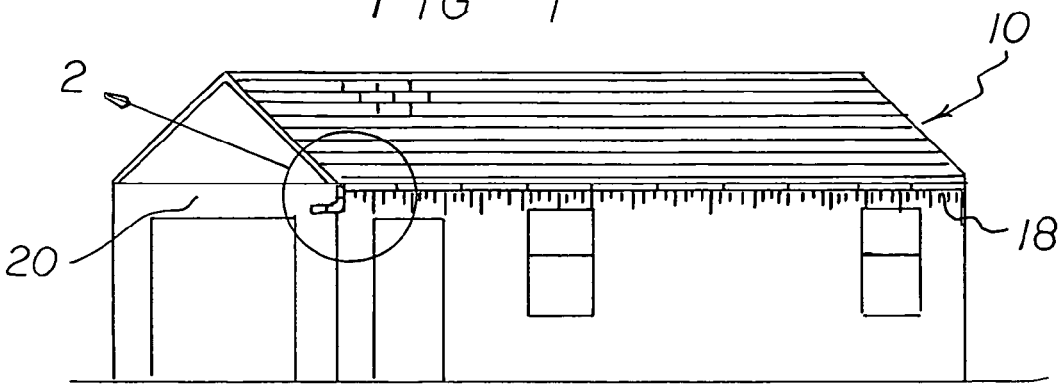
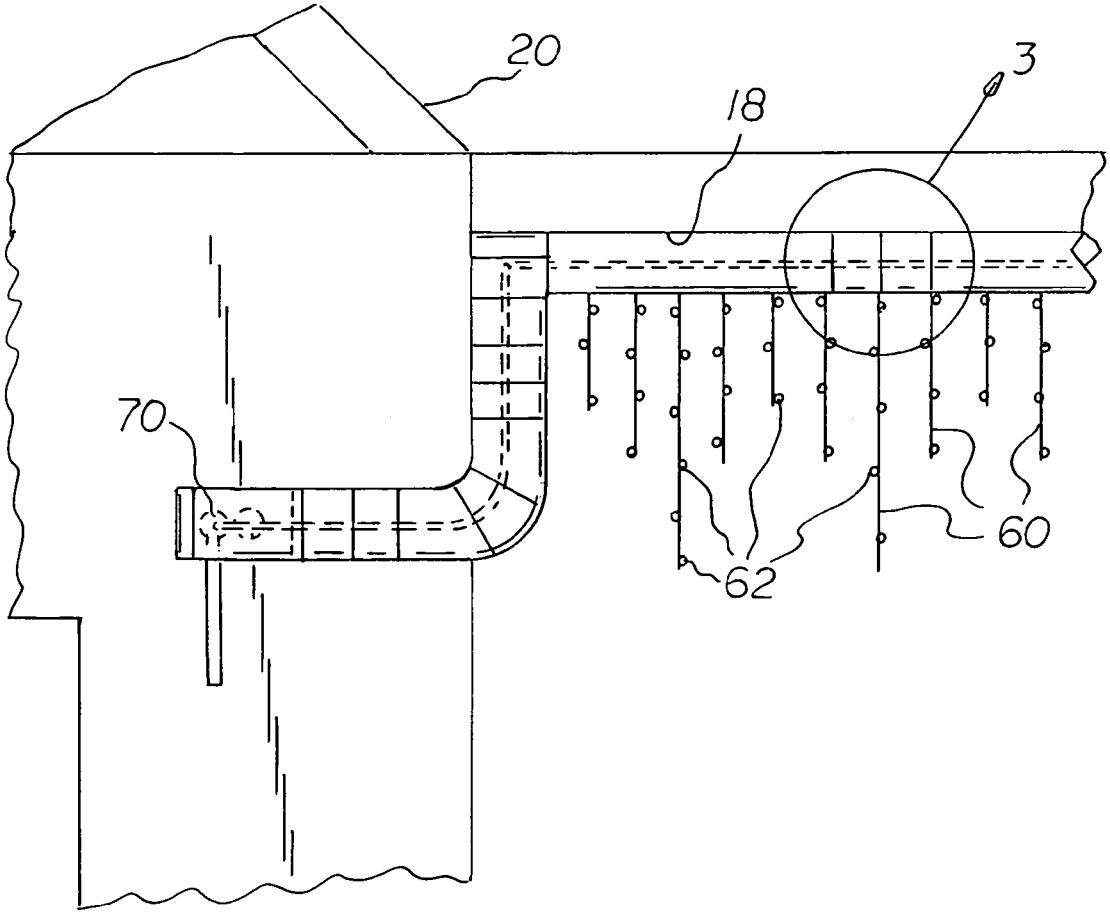
FIG 2

FIG 3
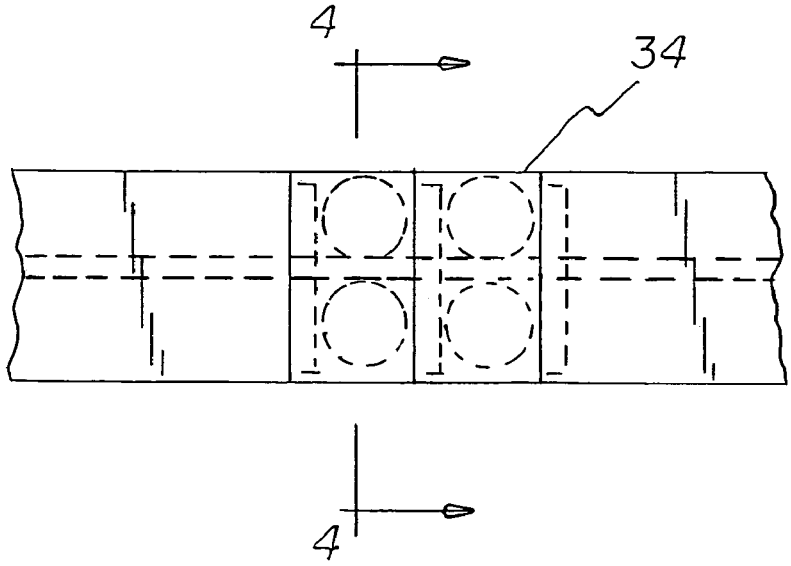
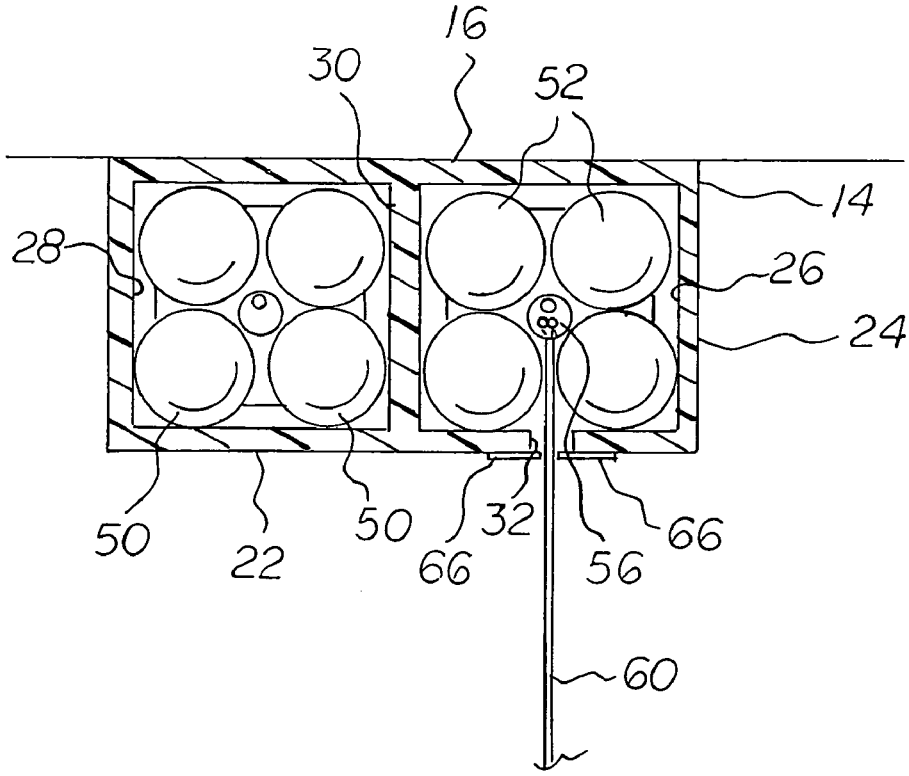
FIG. 4

FIG 5
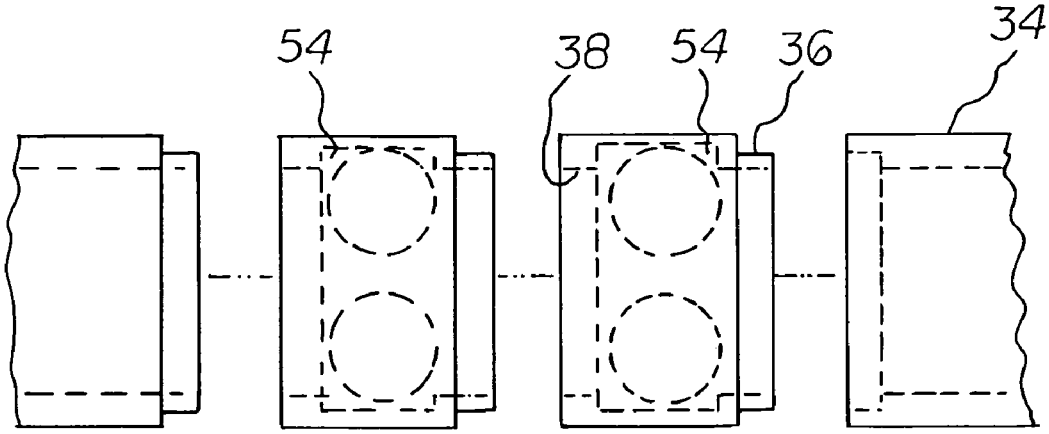
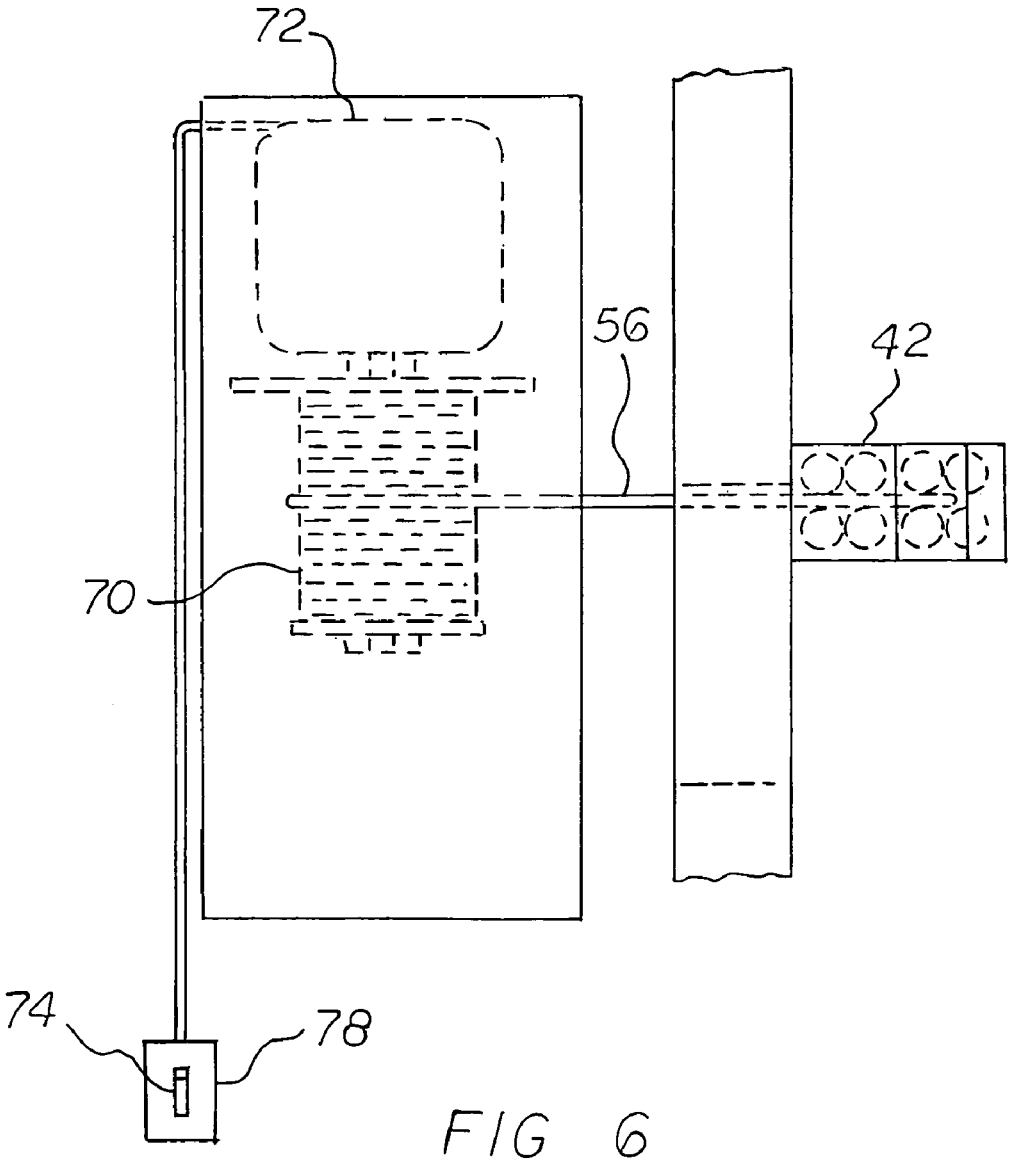
FIG 6

FIG 7
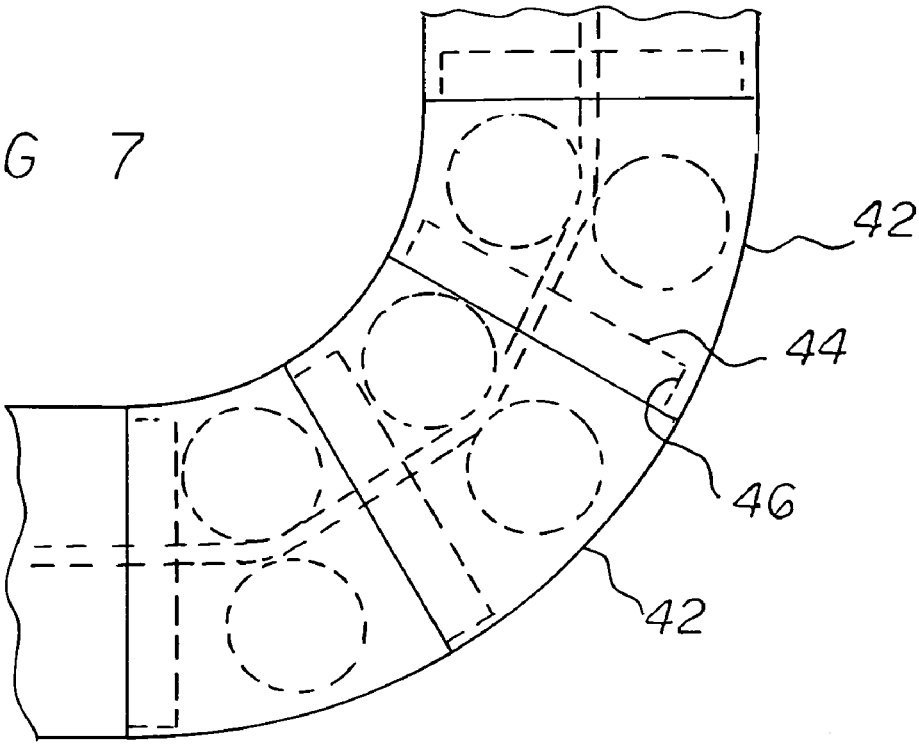
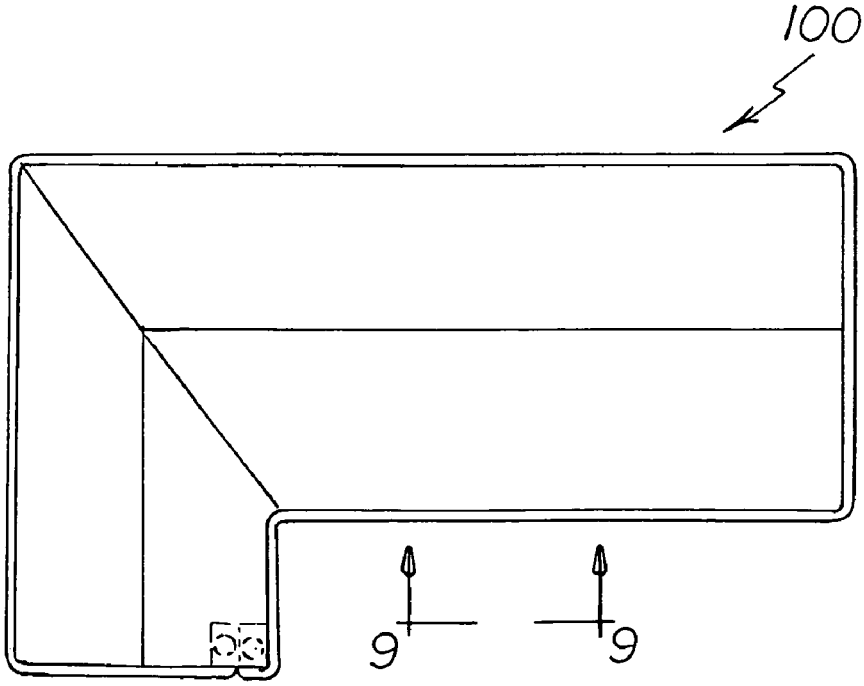
FIG 8

FIG 9
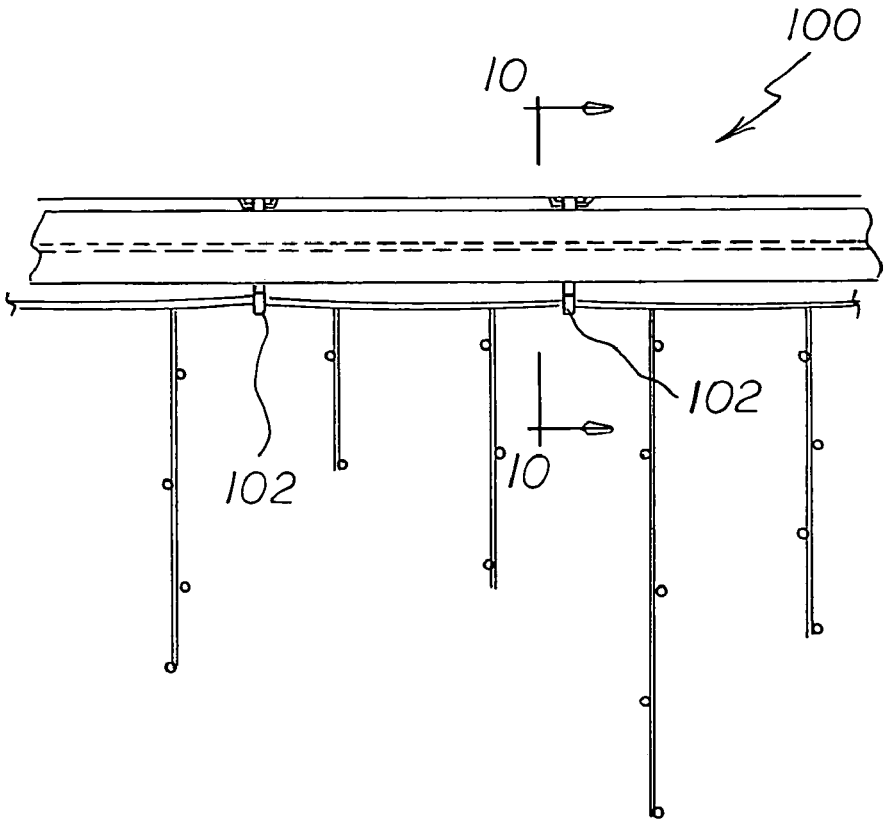
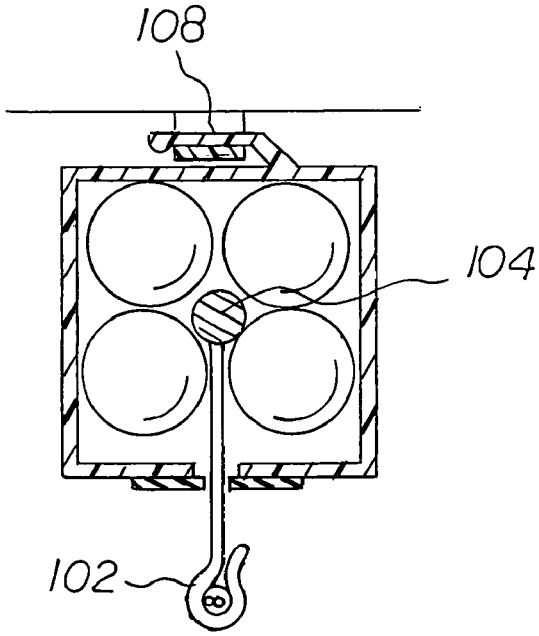
FIG 10

FIG 11
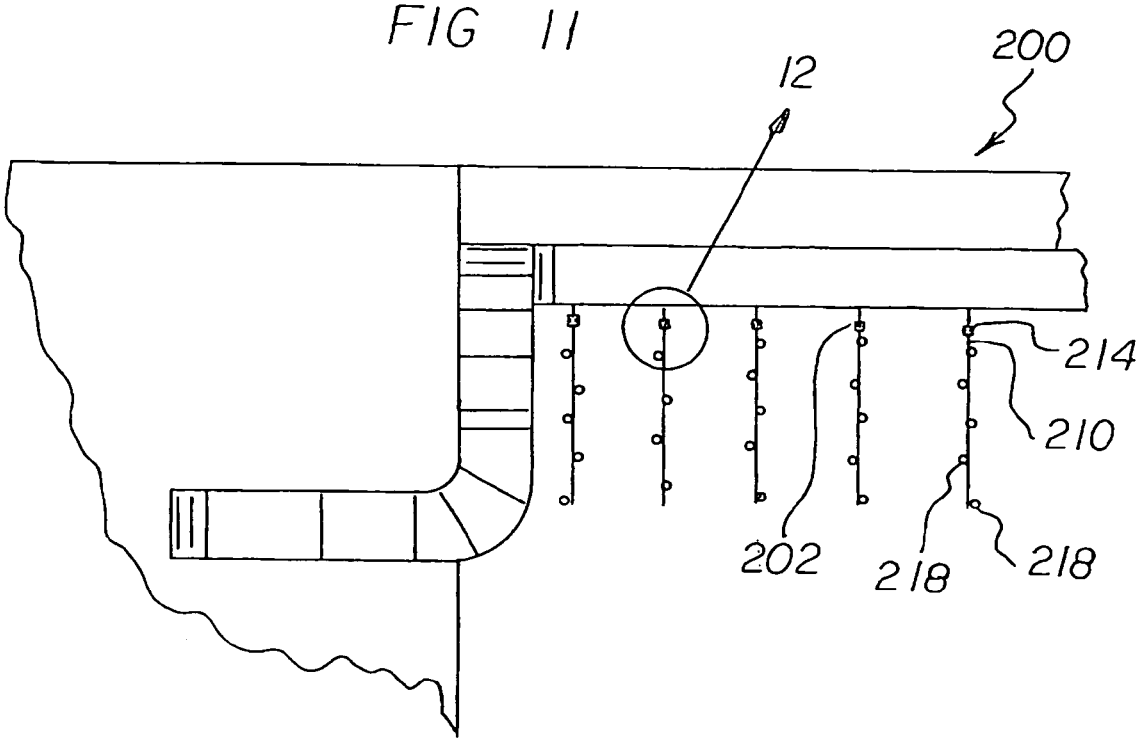
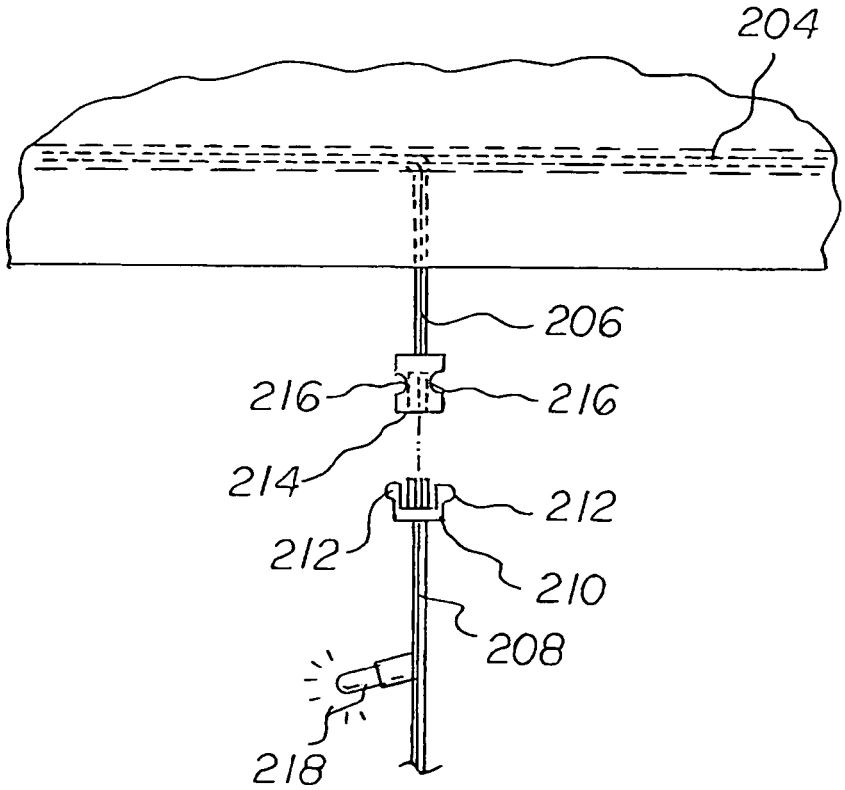
FIG 12

LIGHTING SYSTEM

BACKGROUND OF THE INVENTION

1. Field of the Invention

The present invention relates to a lighting system and more particularly pertains to retractable illumination components adapted to selectively depend beneath the eaves of a building.

2. Description of the Prior Art

The use of lights of known designs and configurations is known in the prior art. More specifically, lights of known designs and configurations previously devised and utilized for the purpose of providing illumination through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,752,407 issued Aug. 14, 1973 to Baugh related to a Christmas Tree Ornament and Decoration Device. U.S. Pat. No. 5,816,687 issued Oct. 6, 1998 to Tapp related to a Method and Apparatus for Hanging Christmas Lights. Lastly, U.S. Pat. No. 6,846,092 issued Jan. 25, 2005 to Taylor related to a Lighting Fixture Device for a Building Structure.

While these devices fulfill their respective, particular objectives and requirements, the aforementioned patents do not describe a lighting system that allows retractable illumination components adapted to selectively depend beneath the eaves of a building.

In this respect, the lighting system according to the present invention substantially departs from the conventional concepts and designs of the prior art, and in doing so provides an apparatus primarily developed for the purpose of retractable illumination components adapted to selectively depend beneath the eaves of a building.

Therefore, it can be appreciated that there exists a continuing need for a new and improved lighting system which can be used for retractable illumination components adapted to selectively depend beneath the eaves of a building. In this regard, the present invention substantially fulfills this need.

SUMMARY OF THE INVENTION

In view of the foregoing disadvantages inherent in the known types of lights of known designs and configurations now present in the prior art, the present invention provides an improved lighting system. As such, the general purpose of the present invention, which will be described subsequently in greater detail, is to provide a new and improved lighting system and method which has all the advantages of the prior art and none of the disadvantages.

To attain this, the present invention essentially comprises a lighting system. First provided is a track assembly. The track assembly has a horizontal upper surface. A building is provided. The building has eaves. The upper surface is adapted to be coupled beneath the eaves of the building. The track assembly has a horizontal lower surface. The track assembly has vertical side surfaces. The side surfaces are provided between the upper and lower-surfaces. The track assembly has a forward track. The track assembly has a laterally displaced return track. The track assembly has a spacer. A spacer is provided between the tracks. The forward and return tracks each have a rectangular configuration. The track assembly has a slot. The slot is provided in the lower surface of the forward track.

Linear track sections are provided. The track sections have a projecting male end. The track sections have a recessed female end. The linear track sections are adapted to couple with respect to each other. In this manner an extended length is provided during operation and use.

Provided next are arcuate track sections. The track sections have a projecting male end. The track sections have a recessed female end. The arcuate track sections are adapted to be coupled with respect to each other and to linear track sections. In this manner an extended length is provided during operation and use.

Four balls are provided. The balls are provided in each track section. The balls include two lower balls. The balls include two upper balls. Each track section has recesses. In this manner the balls are retained in a proper orientation aligned vertically and horizontally.

An electrical primary cord is provided next. The primary cord is provided in a continuous loop. The primary cord extends through the forward and return tracks. The primary cord is located with two balls above and two balls below. In this manner the primary cord may slide through the tracks between an operative display orientation and an inoperative retracted orientation. The primary cord has a diameter greater than the maximum spacing between the lower balls.

A plurality of electrical secondary cords is provided. The secondary cords are of varying lengths. The secondary cords depend from and are electrically coupled to the primary cord beneath the track assembly. The secondary cords have bulbs. The bulbs are located at spaced locations along the lengths of the secondary cords. The secondary cords have a maximum width less than the slot as well as the maximum spacing between the lower balls. In this manner the secondary cords are allowed to depend from a location between the upper and lower balls then between the lower balls and then through the slot for depending there from.

Provided next are elastomeric seals. The elastomeric seals are provided on opposite sides of the slot. In this manner the entrance of moisture into the forward track is abated. The elastomeric seals are spaced a distance less than the width of the slot but greater than the diameter of the secondary cord.

Further provided is a spool. The spool is rotatably positioned in proximity to the track assembly. The spool has a reversible motor. The spool has a switch. The spool provides for rotating the spool in a first direction to position the secondary cords in the forward track in an operative orientation and in a secondary direction to position the secondary cords in the reverse track and on the spool in an inoperative orientation.

Provided last is a source of potential. The source of potential powers the primary and secondary cords and bulbs when in the operative orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved lighting system which has all of the advantages of the prior art lights of known designs and configurations and none of the disadvantages.

It is another object of the present invention to provide a new and improved lighting system which may be easily and efficiently manufactured and marketed.

It is a further object of the present invention to provide a new and improved lighting system which is of durable and reliable constructions.

An even further object of the present invention is to provide a new and improved lighting system which is susceptible of a low cost of manufacture with regard to both materials and labor, and which accordingly is then susceptible of low prices of sale to the consuming public, thereby making such lighting system economically available to the buying public.

Even still another object of the present invention is to provide a lighting system for retractable illumination components adapted to selectively depend beneath the eaves of a building.

Lastly, it is an object of the present invention to provide a new and improved lighting system. A track assembly is adapted to be coupled beneath eaves of a building. The track assembly has forward and return. A slot is provided in the lower surface of the forward track. Spaced balls are provided in each track. A primary cord is in a continuous loop extending through the forward and return tracks. A plurality of secondary members is adapted to depend from the primary cord through the slot to beneath the track assembly. A spool is provided in proximity to the track assembly and primary cord. A motor rotates the spool and moves the primary cord in a first direction to position the secondary members in the forward track in an operative orientation and in a secondary direction to position the secondary members in an inoperative orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a lighting system constructed in accordance with the principles of the present invention.

FIG. 2 is an enlarged side elevational illustration taken at circle 2 of FIG. 1.

FIG. 3 is an enlarged side elevational illustration taken at circle 3 of FIG. 2.

FIG. 4 is a cross sectional view taken along line 4-4 of FIG. 3.

FIG. 5 is an exploded view of the elements illustrated in FIG. 3.

FIG. 6 is a side elevational view taken at the end of the track.

FIG. 7 is a side elevational view taken at the arcuate bend of the track.

FIG. 8 is a plan view of an alternate embodiment of the invention.

FIG. 9 is a side elevational view taken at line 9-9 of FIG. 8.

FIG. 10 is a cross sectional view taken along line 10-10 of FIG. 9.

FIG. 11 is a side elevational view of another alternate embodiment of the invention.

FIG. 12 is an enlarged exploded view taken at circle 12 of FIG. 11.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved lighting system embodying the principles and concepts of the present invention and generally designated by the reference numeral 10 will be described.

The present invention, the lighting system 10 is comprised of a plurality of components. Such components in their broadest context include a track assembly, spaced balls, a plurality of secondary members and a spool. Such components are individually configured and correlated with respect to each other so as to attain the desired objective.

First provided is a track assembly 14. The track assembly has a horizontal upper surface 16. A building 20 is provided. The building has eaves 18. The upper surface is adapted to be coupled beneath the eaves of the building. The track assembly has a horizontal lower surface 22. The track assembly has vertical side surfaces 24. The side surfaces are provided between the upper and lower surfaces. The track assembly has a forward track 26. The track assembly has a laterally displaced return track 28. The track assembly has a vertical spacer 30. A spacer is provided between the tracks to form similarly configured tracks. The forward and return tracks each have a rectangular configuration. The forward track has a slot 32. The slot is provided in the lower surface of the forward track.

Linear track sections 34 are provided. The track sections have a projecting male end 36. The track sections have a recessed female end 38. The linear track sections are adapted to couple with respect to each other. In this manner an extended length is provided during operation and use.

Provided next are arcuate track sections 42. The track sections have a projecting male end 44. The track sections have a recessed female end 46. The arcuate track sections are adapted to be coupled with respect to each other and with respect to linear track sections. In this manner an extended length with ends is provided during operation and use.

Four balls 50, 52 are provided. The balls are provided in each track section. The balls include two lower balls 50. The balls include two upper balls 52. Each track section has recesses 54. In this manner the balls are retained in a proper orientation aligned vertically and horizontally.

An electrical primary cord 56 is provided next. The primary cord is provided in a continuous loop. The primary cord extends through the forward and return tracks. The primary cord is located with two balls above and two balls below. In this manner the primary cord may slide through the tracks between an operative display orientation and an inoperative retracted orientation. The primary cord has a diameter greater than the maximum spacing between the lower balls. The primary cord is adapted to slide over the lower balls while constrained against lateral movement by the two balls on each side.

A plurality of electrical secondary cords 60 is provided. The secondary cords are of varying lengths. The secondary cords depend from and are electrically coupled to the primary cord beneath the track assembly. The secondary cords have bulbs 62. The bulbs are located at spaced locations along the lengths of the secondary cords. The secondary cords have a maximum width less than the width of the slot as well as the maximum spacing between the lower balls. In this manner the secondary cords are allowed to depend from a location between the upper and lower balls then between the lower balls and then through the slot for depending there from.

Provided next are elastomeric seals 66. The elastomeric seals are provided on opposite sides of the slot. In this manner the entrance of moisture and debris into the forward track is abated. The elastomeric seals are spaced a distance less than the width of the slot but greater than the diameter of the secondary cord.

Further provided is a spool 70. The spool is rotatably positioned in proximity to the track assembly and supports the primary cord. The spool has a reversible motor 72. The spool has a switch 74. The spool provides for rotating the spool in a first direction to position the secondary cords in the forward track in an operative orientation and in a secondary direction to retract the secondary cords into the return track and on the spool in an inoperative orientation.

Provided last is a source of potential 78. The source of potential powers the primary and secondary cords and bulbs when in the operative orientation whereby the bulbs will be illuminated.

An alternate embodiment of the present invention is illustrated in FIGS. 8 through 10. In such alternate embodiment 100, the secondary members are hooks 102. The hooks depend from the primary cord 104. The hooks are adapted to support electrical cords with bulbs as in the primary embodiment. This alternate embodiment is illustrated a one track assembly with the ends of the track adjacent to the spool.

Supports 108 are formed on the upper surface of the upper surface of the track assemblies for removable coupling to a building. The coupling may be to any horizontal or essentially horizontal surface of a building or other structure to be decorated such as an eave, gutter, overhang or the like. Such supports are adapted for incorporation into any embodiment of the present invention.

Another alternate embodiment of the present invention is illustrated in FIGS. 10 and 11. In such alternate embodiment, the system 200 features separable couplers 202 on an intermediate extent of each of the secondary members depending from the primary cord 204. Each secondary member has an upper section 206 and a lower section 208. Each separable coupler 202 has a lower component 210 secured to the upper end of the lower section and with outwardly biased fingers 212. Each separable coupler 202 has an upper component 214 secured to the lower end of the upper section and adapted to receive a lower component with recesses 216 receiving the fingers 212. Such arrangement allows a user to urge the fingers inwardly and thereby separate the components of the coupler. When coupled, electrical power is provided from the primary cord through the upper and lower sections of the secondary members to the bulbs 218 on the lower section. In this embodiment, the secondary members are of a common length. It should be understood that any of the embodiments could be constructed with secondary members of a common length or of varying lengths.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lighting system comprising:

a track assembly adapted to be coupled beneath eaves of a building with forward and return tracks and with a slot in the lower surface of the forward track;

spaced balls in each track with a primary cord in a continuous loop extending through the forward and return tracks;

a plurality of secondary members adapted to depend from the primary cord through the slot to beneath the track assembly; and a spool in proximity to the track assembly and primary cord with a motor for rotating the spool and moving the primary cord in a first direction to position the secondary members in the forward track in an operative orientation and in a secondary direction to position the secondary members in an inoperative orientation.

2. The system as set forth in claim 1 wherein the primary cord is an electrical cord and the secondary members are electrical cords with bulbs and further including a source of potential to power the primary and secondary cords and bulbs when in the operative orientation depending from beneath the eaves of a building.

3. The system as set forth in claim 2 and further including a separable coupler on an intermediate extent of each secondary cord.

4. The system as set forth in claim 2 wherein the secondary cords are of varying lengths.

5. The system as set forth in claim 2 wherein the secondary cords are of a common length.

6. The system as set forth in claim 1 wherein the secondary members are hooks depending from the primary cord, the hooks adapted to support electrical cords with bulbs.

7. The system as set forth in claim 1 and further including supports formed on the upper surface of the track assemblies for removable coupling to a building.

8. A lighting system featuring retractable illumination components adapted to selectively depend beneath the eaves of a building comprising, in combination:

a track assembly having a horizontal upper surface adapted to be coupled beneath eaves a building and a horizontal lower surface with vertical side surfaces there between, the track having a forward track and a laterally displaced return track with a spacer between the tracks, the forward and return tracks each having a rectangular configuration with a slot in the lower surface of the forward track;

linear track sections with a projecting male end and a recessed female end, the linear track sections adapted to couple with respect to each other to form an extended length during operation and use;

arcuate track sections with a projecting male end and a recessed female end, the arcuate track sections adapted to couple with respect to each other and to linear track sections to form an extended length during operation and use;

four balls in each track section including two lower balls and two upper balls with recesses in each track section to retain the balls in a proper orientation aligned vertically and horizontally;

a electrical primary cord in a continuous loop extending through the forward and return tracks, the primary cord being located with two balls above and two balls below for the sliding of the primary cord through the tracks between an operative display orientation and an inoperative retracted orientation, the primary cord having a diameter greater than the maximum spacing between the lower balls;

a plurality of electrical secondary cords of varying lengths depending from and electrically coupled to the primary cord beneath the track assembly with bulbs located at spaced locations along the lengths of the secondary cords, the secondary cords having a maximum width less than the slot as well as the maximum spacing between the lower balls to thereby allow the secondary cords to depend from a location between the upper and lower balls then between the lower balls and then through the slot for depending there from;

elastomeric seals on opposite sides of the slot to abate the entrance of moisture into the forward track, the elastomeric seals being spaced a distance less than the width of the slot but greater than the diameter of the secondary cord;

a spool rotatably positioned in proximity to the track assembly with a reversible motor and a switch for rotating the spool in a first direction to position the secondary cords in the forward track in an operative orientation and in a secondary direction to position the secondary cords in the reverse track and on the spool in an inoperative orientation; and a source of potential to power the primary and secondary cords and bulbs when in the operative orientation depending from beneath the eaves of a building.

* * * * *